United States Patent [19]

Noesen et al.

[11] 4,228,583

[45] Oct. 21, 1980

[54] SCREW SOCKET ASSEMBLY DEVICE

[75] Inventors: Stanley J. Noesen, Hendersonville; Fredrick M. Baldwin, Asheville, both of N.C.

[73] Assignee: General Electric Company, Schenectady, N.Y.

[21] Appl. No.: 33,571

[22] Filed: Apr. 27, 1979

[51] Int. Cl.[3] ..... H01R 43/04

[52] U.S. Cl. ..... 29/747; 29/283.5; 29/513; 29/761

[58] Field of Search ..... 339/176 L, 278 L; 29/25.13, 25.19, 761, 747, 283.5, 513; 113/116 CC, 119

[56] References Cited

U.S. PATENT DOCUMENTS

| | | | |
|---|---|---|---|
| 3,062,261 | 11/1962 | Chesser | 29/513 X |
| 3,360,768 | 12/1967 | Winter | 339/199 |
| 3,890,027 | 6/1975 | Orr et al. | 339/64 R |

*Primary Examiner*—Carl E. Hall

*Attorney, Agent, or Firm*—Sidney Greenberg; Lawrence R. Kempton; Philip L. Schlamp

[57] ABSTRACT

Device for securing screw-shell in lamp socket housing. The device comprises a fixed mandrel for holding the terminal tab of the screw-shell which projects through a slot in the housing and a rotatable mandrel on the fixed mandrel for bending the ears adjacent the terminal tab so that the ears engage the socket housing adjacent the slot for retaining the screw-shell in the housing.

6 Claims, 7 Drawing Figures

SCREW SOCKET ASSEMBLY DEVICE

The present invention relates to electrical lamp sockets and more particularly concerns lamp socket screw-shell assemblies.

It is an object of the invention to provide a lamp socket assembly of the above type having improved means for securely retaining the screw-shell within the socket housing.

Another object of the invention is to provide a lamp socket assembly of the above type which facilitates attachment of the screw-shell within the socket housing.

Still another object of the invention is to provide a novel method and device for making a lamp socket assembly of the above type.

A further object of the invention is to provide a lamp socket assembly of the described type which enables ready attachment of a terminal connector to the terminal tab of the screw-shell.

Other objects and advantages will become apparent from the following description and the appended claims.

With the above objects in view, the present invention in one of its aspects relates to a lamp socket assembly comprising, in combination, a socket housing having an open end and a transverse base portion near its other end the housing base portion having at least one slot extending therethrough, electrically conductive shell means arranged in the socket housing having an elongated terminal leg extending along an axis through the slot in the housing base portion, the terminal leg formed at its free end with a terminal tab and a pair of oppositely projecting ears spaced axially away from the terminal tab, the ears being bent about the aforementioned axis so that they extend in opposite directions substantially normal to the plane of the terminal tab, the bent ears engaging the housing base portion adjacent the slot for securely holding the shell means in the socket housing.

In another aspect of the invention, the opposite ears of the elongated terminal leg are bent as described by a device which comprises a fixed mandrel having a slot in its free end for receiving the terminal tab, and a rotatable mandrel surrounding the mandrel and having spaced prongs at its end for engaging the opposite ears of the terminal leg, so that partial rotation of the rotary mandrel, while the fixed mandrel holds the terminal tab stationary, bends the ears to positions substantially normal to the plane of the terminal tab for engaging the housing base portion adjacent the slot as described.

The invention will be better understood from the following descriptions taken in conjunction with the accompanying drawings, in which.

Figure 1:
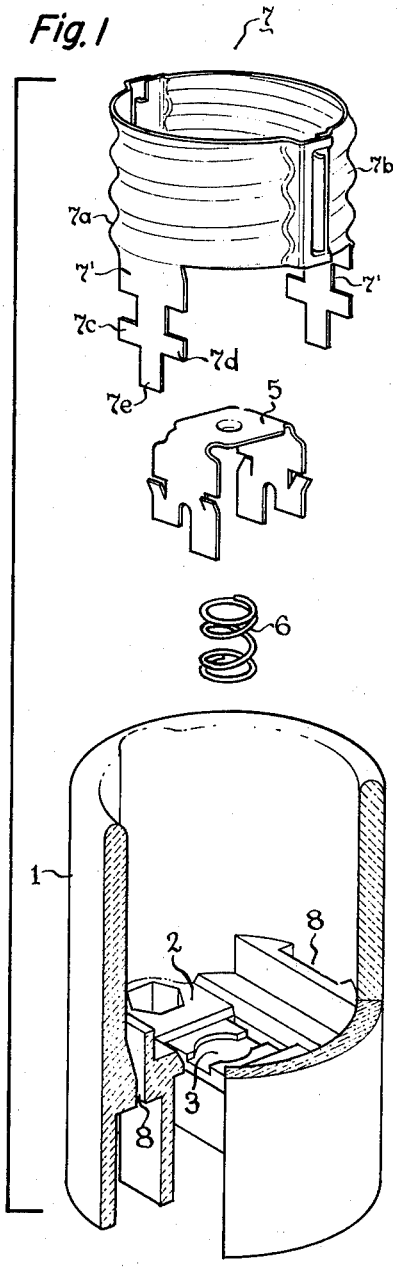
FIG. 1 is an exploded perspective view of a screw-shell and socket assembly to which the present invention is applicable.
Figure 2:
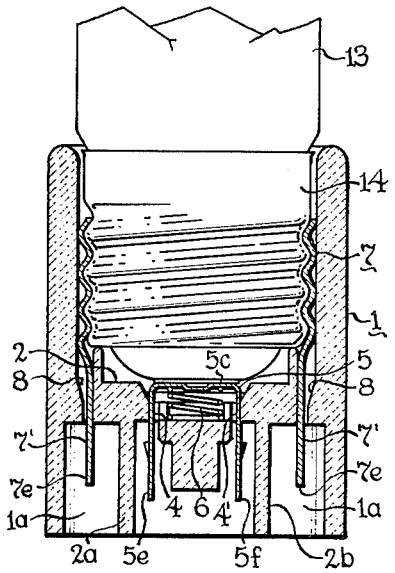
FIG. 2 is a cross-sectional view in elevation of the assembled socket device showing the base portion of a lamp inserted therein.

Referring now to the drawings, and particularly to FIG. 1, there is shown a cylindrical socket housing 1 of electrical insulating material such as porcelain which is open at its top end and is formed with a transverse base portion 2 near its bottom end. In its central region, base portion 2 is formed with a recessed, somewhat circular seat 3 for receiving coil spring 6. On opposite sides of recess 3, base portion 2 has a pair of slots 4, 4' (see FIG. 2) for respectively receiving the legs of a U-shaped conductive contact member 5 which has a web portion **5*c* overlying the top of coil spring 6 in the assembled condition of the parts. The legs of contact member 5 are provided with punched-out projections or barbs, so that when contact member 5 is inserted into slots 4, 4' straddling coil spring 6, the barbs engage the underside of base portion 2 for holding contact member 5 in assembly in socket housing 1 with its web portion pressing resiliently against and compressing coil spring 6**, as seen in FIG. 2.

The legs of contact member 5 have elongated terminal portions or tabs **5*e*, 5*f*, respectively, at their ends which project below the bottom of slots 4, 4'** for receiving push-on terminal connectors of known type (not shown).

The arrangement and functions of central contact member 5, which is readily movable in all directions, is more fully described in the U.S. Pat. No. to Orr et al 3,890,027, issued June 17, 1975 and assigned to the same assignee as the present invention, which patent also discloses a socket housing and screw-shell assembly to which the present invention is applicable.

Fitting within socket housing 1 is conductive screw-shell 7 which comprises two curved shell parts **7*a*, 7*b* having tongue and slot portions at their respective adjoining edges for securing the two parts together. It will be understood, however, that screw-shell 7 may be of conventional unitary form if desired. Projecting downwardly from opposite sides of the cylindrical threaded portion of screw-shell 7 are a pair of terminal strips 7' each having a terminal tab 7*e* at its free end and formed with transverse projections or ears 7*c*, 7*d*, spaced axially away from terminal tab 7*e*, the arrangement being such that when terminal strips 7' are inserted through corresponding slots 8 in base portion 2, the ears 7*c*, 7*d* of the terminal strips may be bent as described hereinafter so that they engage the underside of base portion 2 to hold conductive shell 7 securely in assembly with socket housing 1**.

As seen in FIG. 2, the bottom of base portion 2 is formed with integral partitions **2*a*, 2*b* serving as insulating barriers between shell terminals 7' and central contact terminals 5*e*, 5*f*, and defining with the lower wall of housing 1 narrow spaces 1*a***.

Other details of the structure of socket housing 1 are described and shown in the aforementioned Orr et al patent and the disclosure thereof is accordingly incorporated herein by reference.

When ears **7*c*, 7*d* of terminal strips 7' are only slightly twisted in accordance with prior practice to cause the ears to engage the underside of base portion 2, it is possible that the twisting is insufficient to assure positive retention of the screw-shell in the socket housing. As a result, there may bve a loss of electrical connection and possibly the dropping of the lamp from the fixture. Also, such twisting of the terminal tab in the recess 1***a* below slot 8 often makes it difficult to attach the conventional type of push-on terminal connector to the twisted terminal tab, in view of the extremely limited space in those recesses and the twisted position of the terminal tab therein.

Figure 3:
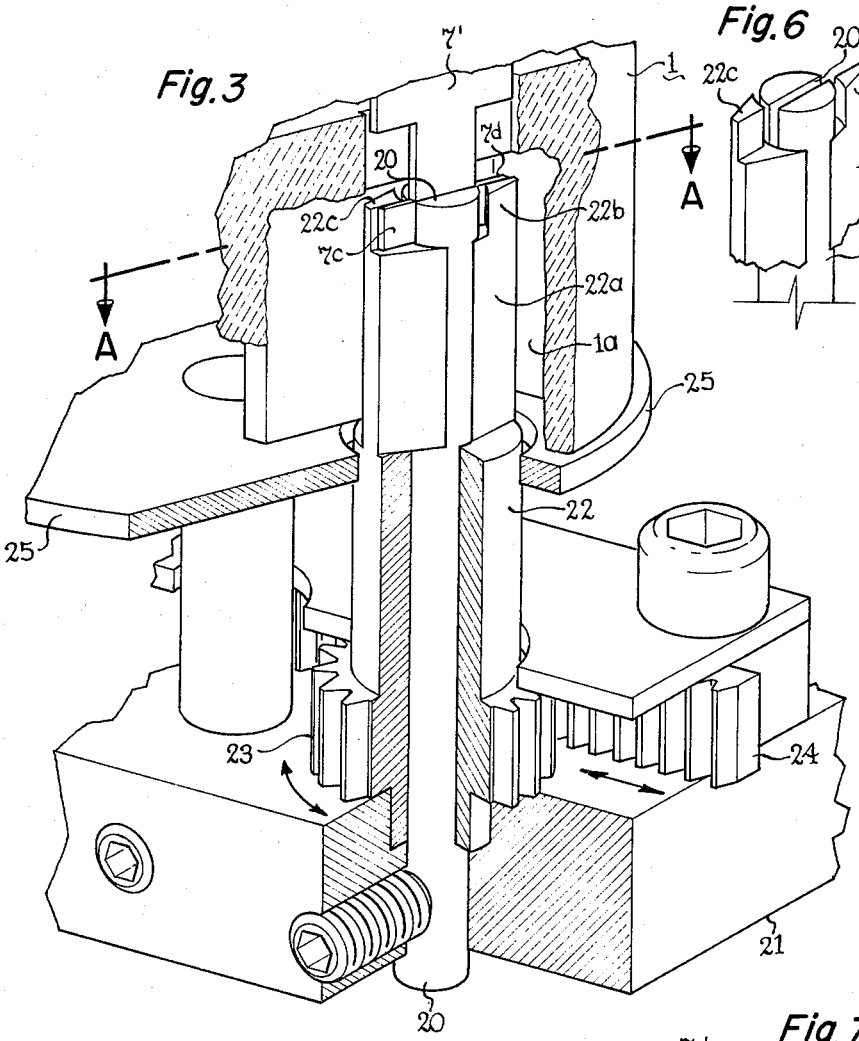
FIG. 3 is a perspective view, with parts broken away, of an assembly apparatus in accordance with an embodiment of the invention.
Figure 6:
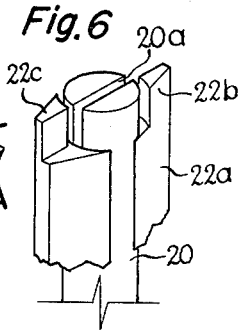
FIG. 6 is a perspective fragmentary view of the associated end portions of the fixed and rotary mandrels of the FIG. 3 apparatus.

In accordance with the invention, the foregoing difficulties are overcome by the provision of a novel method and device whereby the terminal ears are bent about 90° while the terminal tab is held stationary in the socket housing recess. A preferred embodiment of such a device is shown in FIG. 3. Essentially, the device comprises a fixed mandrel for holding the terminal tab stationary and a rotatable mandrel engageable with the terminal ears for bending the ears so that they extend substantially normal to the slot through which the terminal strip passes and thus engage the surface of the socket housing adjacent the slot. As seen in the FIG. 3 embodiment, an elongated cylindrical fixed mandrel 20 is secured at its lower end to a base plate or support 21 and a tubular mandrel 22 arranged coaxially on fixed mandrel 20. The lower portion of rotatable mandrel 22 has an enlarged diameter, the periphery of which has a pinion gear 23 formed thereon or suitably attached thereto. Coacting with pinion gear 23 is gear rack 24 which may be reciprocated as indicated by the arrows for turning rotable mandrel 22 through a desired angle in opposite directions. At its upper end, fixed mandrel 20 is formed with a slot 20*a* (See FIG. 6) for receiving terminal tab 7*e* therein.

Figure 4:
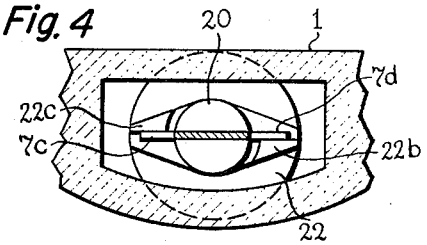
FIG. 4 is a top view of the fixed and rotary mandrels engaging the terminal ears and tab, as taken along the line A—A of FIG. 3.

At its lower end, rotatable mandrel 22 is journaled in base plate 21 for free rotation about fixed mandrel 20. The upper end portion 22*a* of rotatable mandrel 22 is suitably relieved, as seen in FIG. 3, to permit insertion of that portion into the confined space 1*a* of socket housing 1. End portion 22*a* is further formed at its free end with a pair of radially extending prongs or lugs 22*b*, 22*c* arranged spaced on opposite sides of the axis or rotatable mandrel 22 for engaging terminal ears 7*c*, 7*d*. In the illustrated apparatus, table 25 on which socket housing 1 is placed is so arranged and the dimensions of the parts of the fixed and rotatable mandrels are such that with socket housing 1 resting on table 25, the bottom of terminal tab 7*e* extends substantially to the bottom of slot 20*a* of fixed mandrel 20, and, as seen in FIG. 4, opposite terminal ears 7*c*, 7*d* extend respectively adjacent the vertical radial surfaces of prongs 22*b*, 22*c*. Preferably, the arrangement is such that the top of ears 7*c*, 7*d*, and top ends of prongs 22*b*, 22*c* and fixed mandrel 20 are all coplanar.

As seen in FIG. 4, the vertical radial surfaces of prongs 22*b*, 22*c* lie in parallel planes which are sufficiently spaced from each other to accommodate the thickness of terminal ears 7*c*, 7*d*. Prongs 22*b*, 22*c* are each further formed with a circumferentially curved inner vertical surface which is radially spaced from the adjacent surface of fixed mandrel 20 a distance at least about equal to the thickness of ears 7*c*, 7*d*, and preferably slightly greater than the ear thickness.

In carrying out the assembly process in accordance with the invention, socket housing 1, with screw-shell 7 inserted therein as seen in FIG. 2, is placed on table 25 with the lower portion of terminal strip 7' inserted in mandrels 20 and 22 as shown in FIG. 3. It will be understood that in a typical procedure, a similar set of fixed and rotary mandrels (not shown) is arranged spaced from the mandrels illustrated for similarly engaging the other terminal strip 7' depending from screw-shell 7, the arrangement preferably being such that the ears on both terminal strips are simultaneously bent as described by operation of rack 24 which engages the pinion gears of both rotary mandrels. With socket housing 1 in place as shown, rack 24 is moved (by hand or any other suitable means) to the left, causing rotary mandrel 22 to turn counterclockwise as viewed from the top (see FIG. 4) resulting in bending ears 7*c*, 7*d* so that they extend in opposite directions, while terminal tab 7*e* is held stationary by mandrel 20.

Figure 5:
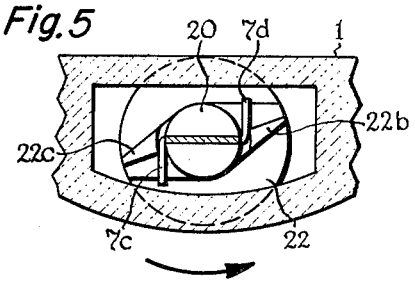
FIG. 5 is a view similar to FIG. 4 showing the bending of the terminal ears by turning of the rotary mandrel.

FIGS. 4 and 5 are views of the parts as taken along the line A—A in FIG. 3. FIG. 4 shows the initial position of prongs 22*b*, 22*c* of rotary mandrel 22 relative to ears 7*c*, 7*d* of terminal strip 7', while FIG. 5 shows the final bent position of ears 7*c*, 7*d* after counterclockwise rotation of rotary mandrel 22.

Figure 7:
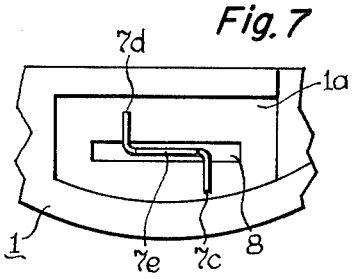
FIG. 7 is a bottom view of the slotted base portion of the socket housing showing the position of the bent terminal ears relative thereto.

By virture of the described configuration and arrangement of prongs 22*b*, 22*c*, rotary mandrel 22 need only be turned through a relatively small angle (e.g., about 20°) to cause the ears 7*c*, 7*d* to be bent 90° to the plane of terminal strip 7', and thus extend in opposite directions substantially normal to slot 8 (see FIG. 7) in socket housing 1 for securely engaging the surfaces adjacent the slot opening. As will be evident from FIG. 5, such bending of the ears is achieved primarily by engagement of the leading corners of the respective 22*b*, 22*c* prongs with the ears, rather than by contact of the vertical radial surfaces against the ears.

The assembly method and apparatus provided by the invention affords a number of advantages over prior methods of socket assembly. By bending the terminal projections at right angles to the slot in the socket housing, the screw-shell is more securely retained against loosening and separation from the socket housing. The described bending prongs of the rotary mandrel serve to provide an optimum bending radius on the terminal ears to avoid overstressing and thereby weakening the ears. By keeping the bottom terminal tab straight while the terminal ears are being bent, the described arrangement facilitates the connection of the external terminal connector to the terminal tab. It is evident that, in addition, the invention affords substantial savings in labor and time in producing a secure socket-screw-shell assembly.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What we claim as new and desire to secure by Letters Patent of the United States is:

1. Apparatus for securing a screw-shell to a lamp socket housing, wherein the screw-shell has a terminal strip extending through a slot in the housing into a confined space between the slot and the open bottom of the socket housing, the terminal strip being formed at its free end with a terminal tab and a pair of oppositely projecting ears spaced axially away from the terminal tab, said apparatus comprising a fixed mandrel having a slot at its end for receiving the terminal tab, and a tubular mandrel surrounding and rotatable about said fixed mandrel, said tubular mandrel formed at its end with a pair of radially spaced projections for respectively engaging the opposite ears of the terminal strip, and means for turning said tubular mandrel for bending the opposite ears about 90° to the plane of the terminal strip while said fixed mandrel holds the terminal tab stationary.

2. Apparatus as defined in claim 1, said projections having oppositely facing surfaces extending along a plane substantially normal to the axis of said tubular mandrel and having inner surfaces extending substantially concentric with said fixed mandrel.

3. Apparatus as defined in claim 2, the adjacent ends of said fixed and rotatable mandrels being substantially co-planar, the slot in said fixed mandrel and said oppositely facing surfaces of said rotatable mandrel being aligned along said plane for receiving the terminal strip ears and tab prior to bending the ears.

4. Apparatus as defined in claim 2, said inner surfaces of said projections being spaced from the periphery of said fixed mandrel a distance at least about equal to the thickness of the terminal ears.

5. Apparatus as defined in claim 1, said turning means comprising pinion means on said tubular mandrel and rack means coacting with said pinion means and movable for turning said tubular mandrel in opposite directions.

6. Apparatus as defined in claim 1, including support means for supporting the lamp socket housing in a position wherein the terminal strip extends into said slot of said fixed mandrel and the terminal ears extend between said radially spaced projections of said tubular mandrel.

* * * * *